US007967166B2

(12) United States Patent
Pham et al.

(10) Patent No.: US 7,967,166 B2
(45) Date of Patent: Jun. 28, 2011

(54) RECLOSABLE STORAGE BAG ATTACHED TO CONTAINER BY REMOVABLE RETAINER RING

(75) Inventors: Linh Pham, Chula Vista, CA (US); Martin Calvo, Chula Vista, CA (US); Dax Machovec, Chula Vista, CA (US)

(73) Assignee: Illinois Tool Works Inc., Glenview, IL (US)

( * ) Notice: Subject to any disclaimer, the term of this patent is extended or adjusted under 35 U.S.C. 154(b) by 519 days.

(21) Appl. No.: 11/985,590

(22) Filed: Nov. 16, 2007

(65) Prior Publication Data

US 2008/0237239 A1 Oct. 2, 2008

Related U.S. Application Data

(60) Provisional application No. 60/896,973, filed on Mar. 26, 2007.

(51) Int. Cl.
*B65D 1/32* (2006.01)
*B65D 6/12* (2006.01)

(52) U.S. Cl. ..... 220/723; 220/495.06; 220/676; 383/44; 383/46

(58) Field of Classification Search ..... 220/495.06, 220/723, 676; 53/469; 137/512.15; 383/44, 383/46

See application file for complete search history.

(56) References Cited

U.S. PATENT DOCUMENTS

| | | | | |
|---|---|---|---|---|
| 2,364,012 | A * | 11/1944 | Walton et al. | 229/117.28 |
| 3,620,409 | A * | 11/1971 | Rosenbaum | 220/745 |
| 5,246,114 | A * | 9/1993 | Underwood | 206/524.8 |
| 5,282,322 | A * | 2/1994 | Kasuya | 34/93 |
| 6,202,849 | B1 | 3/2001 | Graham | |
| 6,499,574 | B1 * | 12/2002 | Anthony | 190/36 |
| 6,575,191 | B2 * | 6/2003 | Skeens et al. | 137/512.15 |
| 6,837,268 | B2 * | 1/2005 | Skeens et al. | 137/550 |
| 7,350,541 | B2 * | 4/2008 | Kobetsky | 137/854 |
| 7,588,160 | B2 * | 9/2009 | Chen | 220/495 |
| 2005/0236427 | A1 * | 10/2005 | Farha et al. | 222/105 |

FOREIGN PATENT DOCUMENTS

DE 202004009263 9/2004

* cited by examiner

*Primary Examiner* — Anthony Stashick
*Assistant Examiner* — Ned A Walker
(74) *Attorney, Agent, or Firm* — Ostrager Chong Flaherty & Broitman P.C.

(57) ABSTRACT

A storage system comprising: an evacuable and reclosable bag comprising a wall made of a flexible material and a one-way valve attached to said wall of said bag; a container having walls made of a material less flexible than the flexible material; and an attachment device that attaches the bag to the container such that at least a portion of the bag resides within the container. To use this storage system, compressible articles are placed inside the evacuable bag. Then the bag is hermetically sealed and evacuated. During evacuation, the shape of the compressible articles inside the bag conform to the shape of the container interior volume. In one embodiment, when the bag with compressed articles is removed from the container, its shape facilitates stacking. In another embodiment, the storage bag with compressed articles remains inside the container.

6 Claims, 7 Drawing Sheets

RECLOSABLE STORAGE BAG ATTACHED TO CONTAINER BY REMOVABLE RETAINER RING

RELATED PATENT APPLICATION

This application claims the benefit, under Title 35, United States Code, §119(e), of U.S. Provisional Application No. 60/896,973 filed on Mar. 26, 2007.

BACKGROUND

This invention generally relates to evacuable storage containers, and in particular, to evacuable reclosable and flexible storage bags.

Collapsible, evacuable storage containers typically include a flexible, airtight bag, an opening through which an article is inserted inside the bag, and a fixture through which excess air is evacuated. A user places an article into the bag through the opening, seals the opening, and then evacuates the air in the bag through the fixture. With the bag thus evacuated, a compressible article contained therein may be significantly compressed so that it is easier to transport and requires substantially less storage space.

For example, compressible items such as clothing may be stored in collapsible, evacuable storage containers. The compressed items may then be stacked on shelves in a closet or other storage area. It is desirable that the compressed items be stackable in a stable configuration inside a storage space. There is a need for a system that will enable compressed items to be stacked with little tendency for the stacked items to slide or fall off of the stack.

SUMMARY

The invention is directed to systems and methods for storing compressible articles.

One aspect of the invention is a storage system comprising: an evacuable and reclosable bag comprising a wall made of a flexible material and a one-way valve attached to the wall of the bag; a container having walls made of a material less flexible than the flexible material; and an attachment device that attaches the bag to the container such that at least a portion of the bag resides within the container.

Another aspect of the invention is a storage system comprising: a receptacle having an interior volume and a mouth that allows communication between an exterior and the interior volume, the receptacle comprising a wall made of a flexible material; a reclosable closure installed in the mouth; a one-way valve mounted to a hole in the receptacle wall; a container having walls made of a material less flexible than the flexible material; and an attachment device that attaches the bag to the container such that at least a portion of the bag resides within the container.

A further aspect of the invention is a storage system comprising: an evacuable and reclosable bag comprising a wall made of a flexible material and a one-way valve attached to the wall of the bag; a container precursor comprising walls made of a material less flexible than the flexible material, contiguous ones of the walls being pivotable relative to each other such that the container precursor is generally flat in a collapsed state and forms a container having an interior volume in an assembled state; and an attachment device that attaches the bag to the container precursor such that at least a portion of the bag will reside within the interior volume of the container in the assembled state.

Yet another aspect of the invention is a method of storing compressible contents in a storage bag, comprising the following steps: (a) arranging an evacuable reclosable bag having a wall made of flexible material such that a portion thereof lies inside a container having walls made of material less flexible than the flexible material; (b) placing compressible contents inside the bag; (c) closing the bag after the compressible contents have been placed inside; and (d) drawing air out of the bag after the bag has been closed until the compressible contents have been sufficiently compressed to fit inside the container.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION

Figure 1:
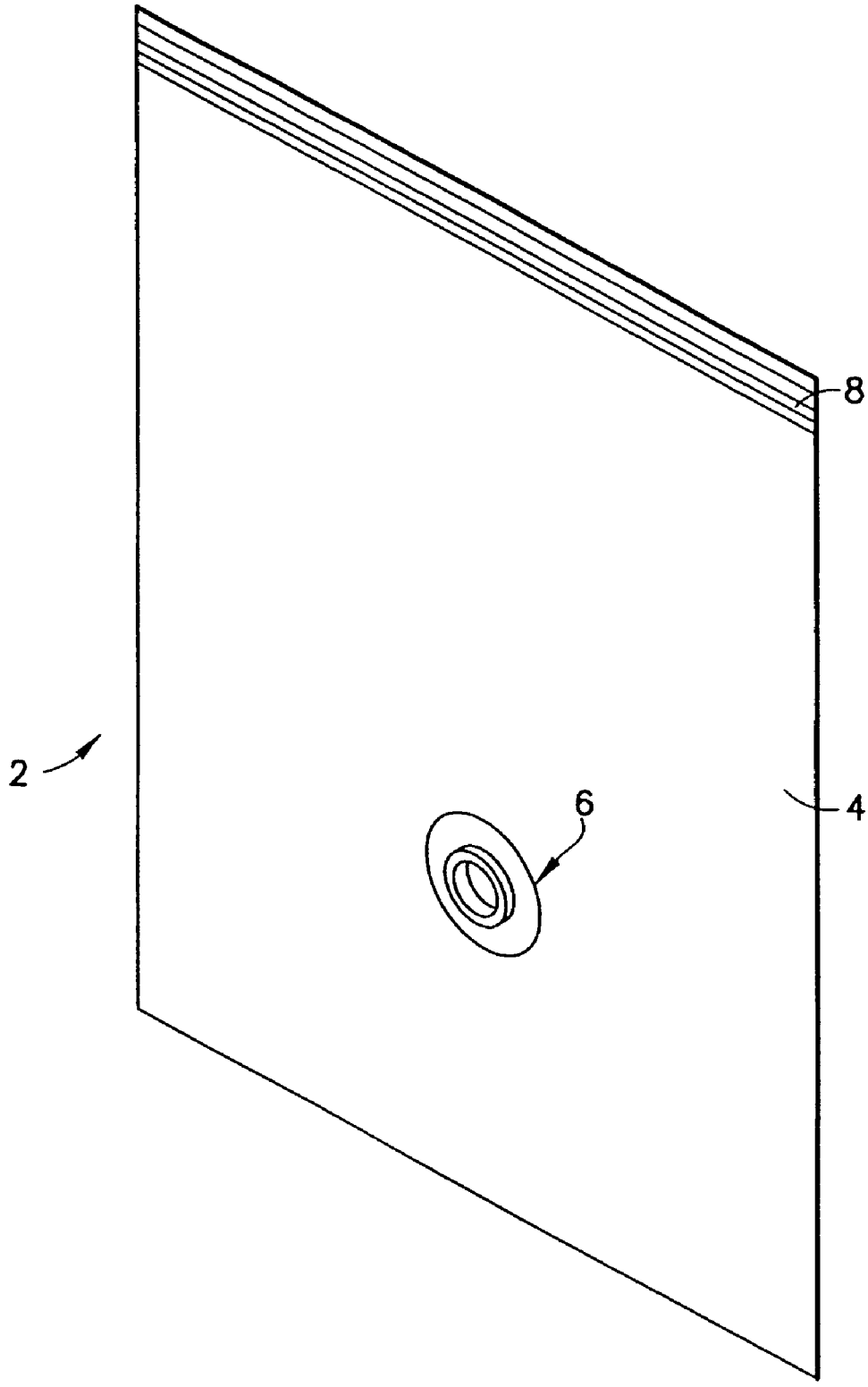
FIG. 1 PRIOR ART
FIG. 1 is a drawing showing an isometric view of one conventional type of collapsible, evacuable storage bag.

FIG. 1 shows a conventional collapsible, evacuable storage bag 2 comprising a flexible receptacle 4, a one-way valve assembly 6, and a reclosable means 8. For example, the reclosable means may take the form of an extruded plastic zipper comprising a pair of mutually interlockable zipper strips that are joined to each other at opposing ends thereof; mutually opposing strips of cohesive material; or a strip of low-tack pressure-sensitive adhesive material. Although not shown in FIG. 1, the conventional valve assembly 6 also typically comprises a cap that can be snapped onto a portion of the valve assembly that is disposed on the exterior of the receptacle 4. The cap must be removed before the bag can be evacuated, and then is replaced after the bag has been evacuated. The cap is intended to supplement the air pressure on the diaphragm and help to seal the valve assembly to prevent air from entering the evacuated bag.

The receptacle 4 typically comprises front and rear walls or panels (made of flexible thermoplastic material) that are joined together at the bottom and two sides by conduction heat sealing to form a receptacle having an interior volume and a mouth in which the reclosable means 8 is installed. However, the receptacle may have any known construction, including, for example, side gussets with or without a bottom panel. Also, the front and rear walls may be connected by a fold instead being joined by a heat seal. One wall of receptacle 4 has a hole (not shown in FIG. 1) in which to install the valve assembly 6. The bag may be constructed of a blended extrusion layer of polyethylene sandwiched between a nylon layer and a layer of polyethylene sheeting.

During use, one or more discrete compressible articles (not shown in FIG. 1) may be placed inside the receptacle 4 while the reclosable means 8 is open, e.g., while the closure profiles of two interlockable zipper strips are disengaged from each other. After the articles to be stored have been placed inside the bag, the mouth of the receptacle 4 can be sealed, e.g., by pressing the zipper strips together to cause their respective closure profiles to interlock with each other. Although the zipper closure profiles may have many different designs, the design must be one that ensures that an airtight seal can be formed at the mouth of the bag.

With the reclosable means 8 closed, the interior volume of the bag or receptacle 4 is hermetically sealed. The interior volume can now be evacuated by sucking air out of the bag via the one-way valve assembly 6. Air can be drawn out of receptacle 4 through valve assembly 6 using a conventional vacuum source, such as a household or industrial vacuum cleaner. The valve assembly 6 and the reclosable means 8 maintain the vacuum inside receptacle 4 after the vacuum source is removed.

Figure 2:
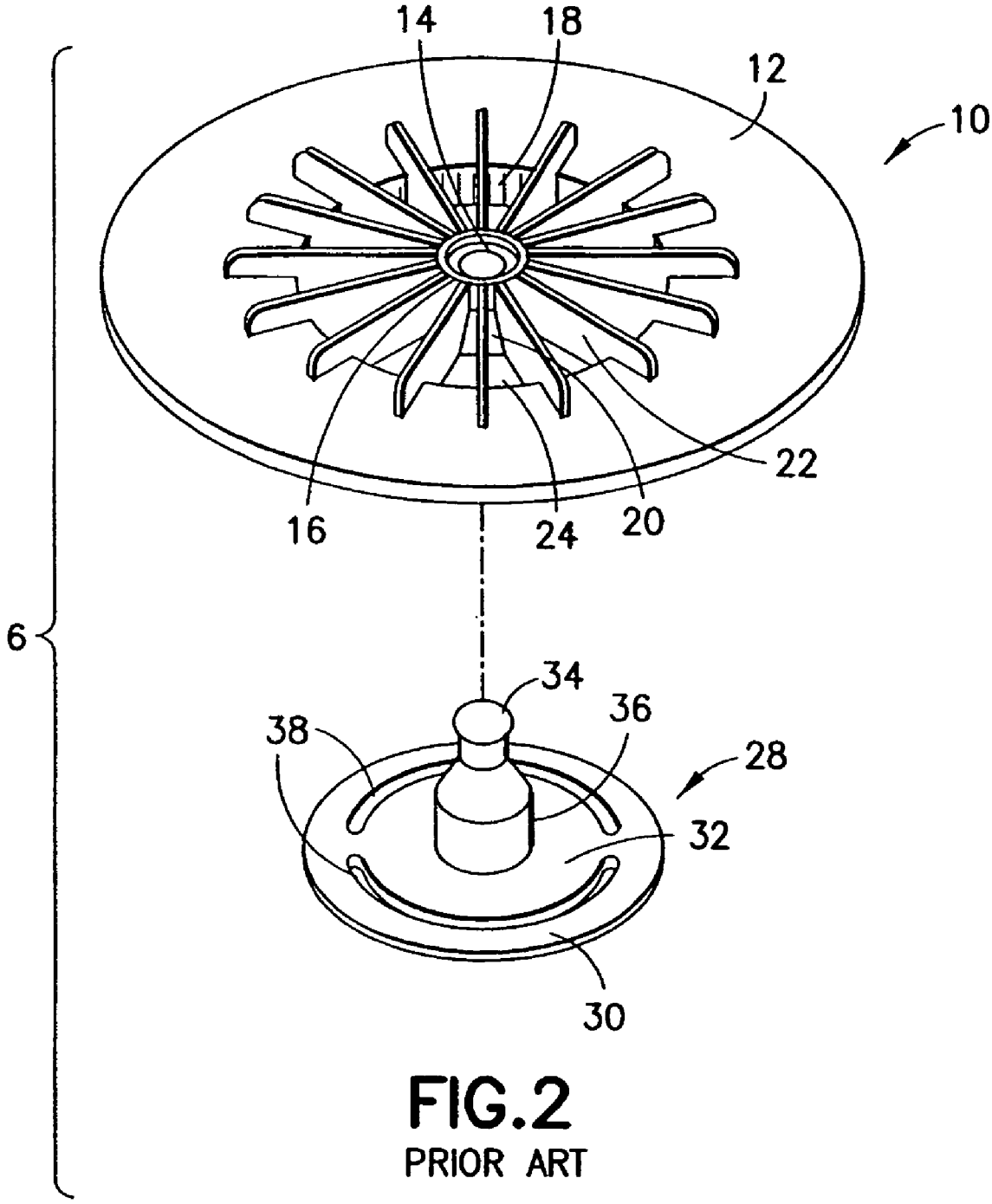
FIG.2 PRIOR ART
FIG. 2 is a drawing showing an exploded isometric view of a known valve assembly suitable for use with a bag of the type depicted in FIG. 1.

One conventional type of valve assembly will now be described with reference to FIGS. 2 and 3. FIG. 2 is an exploded isometric view showing a conventional valve assembly 6. The valve assembly 6 comprises a base 10 and a valve element 28. The valve assembly 6 is mounted to the receptacle 4 (see FIG. 1) such that an annular flange 12 of base 10 is on the inside of the bag. Base 10 extends through the hole in the bag and is held in place by welding the base flange 12 to the bag material to provide the seal.

The valve element 28 provides the one-way airflow feature in valve assembly 6. In a known embodiment, the valve element 28 is made of clear polyvinylchloride (PVC). Valve element 28 has an outer annular portion 30 and an inner diaphragm 32. The annulus 30 and diaphragm 32 are connected by respective neck or bridge portions, but are otherwise separated by a pair of arc-shaped slots or gaps 38. The annular portion 30 functions as a face against which a vacuum source, such as a conventional household or industrial vacuum cleaner nozzle (not shown), may be sealed as the nozzle is pressed against the base 10. When the nozzle is in place and a vacuum device or source draws air through the nozzle, the diaphragm 32 flexes open and air inside the bag passes through a plurality of holes 20 in base 10 and into the vacuum nozzle. When the nozzle is removed, the diaphragm 32 returns to its original shape and seals against the base 10, thus preventing air from passing back into the bag through holes 20 in the base.

As shown in FIG. 2, a plurality of radial vanes 22 separate holes 20. Vanes 22 radiate outward from a circular inner sidewall 16 that supports an annular seat 14. The annular valve element seat 14 surrounds an opening through which the head 34 at the end of the stem 36 of the valve element 28 is passed, as best seen in FIG. 3. FIG. 3 is a cross-sectional view of the assembled valve assembly 6, the section plane being parallel to and intersecting the central axis indicated by a dash-dot line in FIG. 2. The annular seat 14 is a ring having an outer diameter greater than the outer diameter of the head 34 and having an inner diameter less than the outer diameter of the head 34. The valve element 28 is made of an elastic material, so that the head 34 compresses as it passes through the opening in the annular seat 14 and then expands on the other side, in which state the undersurface of the head rests on and is supported by the seat 14.

Figure 3:
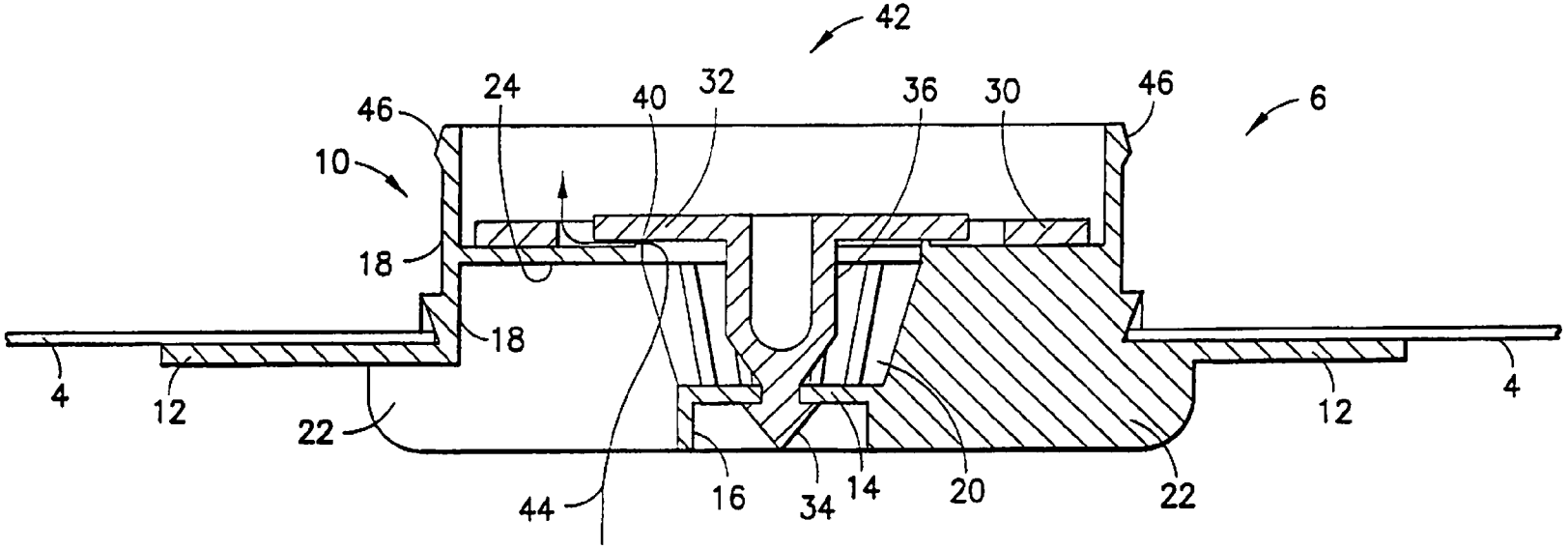
FIG.3 PRIOR ART
FIG. 3 is a drawing showing a cross-sectional view of a known valve assembly attached to a bag of the type depicted in FIG. 1 (the cap of the valve assembly is removed).

Still referring to FIG. 3, the base 10 further comprises a circular outer sidewall 18 that supports another annular valve element seat 24. The annular seat 24 is a ring having an outer diameter greater than the outer diameter of the outer annular portion 30 of the valve element 28 and having an inner diameter greater than the maximum diameter of the stem 36. The outer annular portion 30 of the valve element 28 sits on the seat 24, while the diaphragm 32 sits on a circular bead 40 that projects above the plane of the surface of seat 24 at the edge of a circular opening 42 provided in the base 10. Bead 40 has a generally constant profile along its circumference.

In FIG. 3, the valve base 10 is shown inserted through an opening in receptacle 4. A vacuum source (not shown) can be placed with the terminus of its nozzle pressed against the outer annular portion 30 to draw air through the valve. The suction applied by the vacuum nozzle causes the diaphragm 32 to flex. The opening 42 is in fluid communication with the multiplicity of holes 20 when any portion of the diaphragm 30 is lifted off of the bead 40. The flow of air out of the bag during suction is indicated by the arrow 44 in FIG. 3. During lifting of the diaphragm 32, the head 34 is latched behind the seat 14, thereby preventing the valve element from popping out of the base 10. When the vacuum source nozzle is removed, diaphragm 32 returns to its position sealed against bead 40 so as to prevent air from flowing in a reverse direction through the valve.

Figure 4:
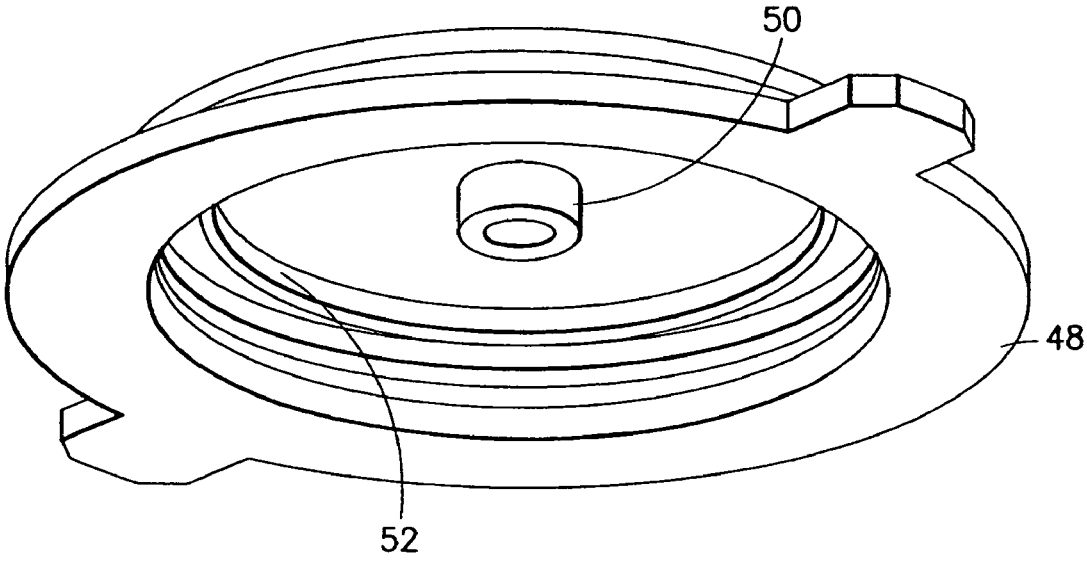
FIG.4 PRIOR ART
FIG. 4 is a drawing showing an isometric view of a known cap for a valve assembly.

It is known to place a removable cap 48 (shown in FIG. 4) over the opening 42 (shown in FIG. 3) to protect inner portions of the one-way valve assembly 6. After the vacuum source has been removed, the cap can be snapped onto the end of the sidewall 18, which has an outer peripheral bead 46. Bead 46 has a generally constant profile along its circumference. The cap has a sidewall with an inner peripheral bead that is pushed past the bead 46. The cap will be held on by frictional forces as well as by the resistance presented by the bead 46 to removal of the cap. It is known to provide a central post 50 inside the cap 48 (see FIG. 4) that presses the central portion of the diaphragm (at the base of the stem 36 shown in FIG. 3) downward when the cap is pushed onto the base sidewall 18. This design is intended to exert a pressure that maintains the diaphragm 32 in contact with the bead 40 on the seat 24. The known cap also has a circular downwardly depending wall 52 that stops the cap as it is pressed onto the base.

The person skilled in the art of manufacturing reclosable bags on a machine would readily appreciate that instead of forming the bag from two separate webs of plastic film joined together on three sides, the bag can be formed from a single web of film that has been folded, cut and then side sealed. In the completed bag, this fold will form the bottom of the bag, while the two side seals are formed by conduction heat sealing. Alternatively, the bags could be made by forming a tube of bag making material (with or without side gussets) and then forming a bottom seal by application of heat.

Figure 5:
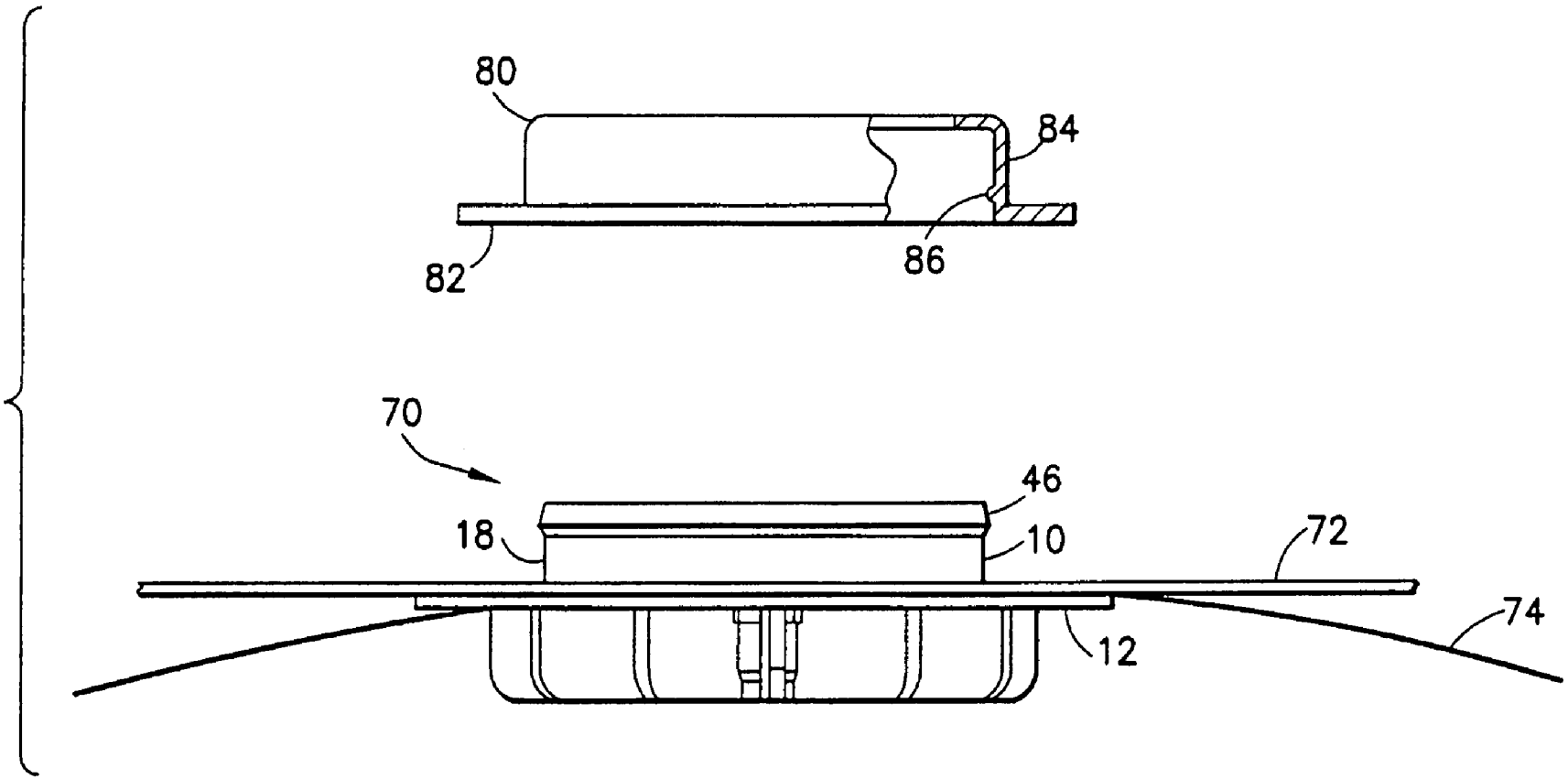
FIG. 5 is a drawing showing an elevational view of a valve assembly of an evacuable reclosable storage bag mounted in an opening in a container wall and a partially sectioned elevational view of a retainer ring to be coupled to the valve assembly for retaining the latter in its mounted position in accordance with one embodiment of the invention.
Figure 6:
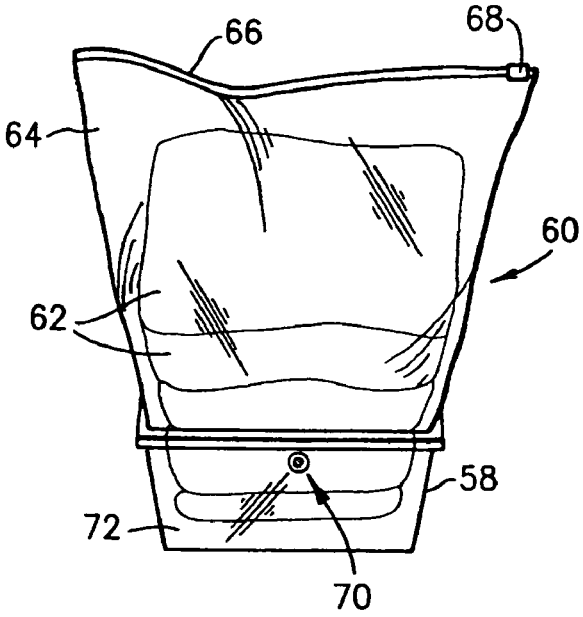
FIG. 6 is a drawing showing a perspective view of an evacuable reclosable storage bag combined with a plastic container by means of a device of the type depicted in FIG. 5. The bag is shown in an unevacuated state with compressible articles (e.g., towels or clothing) contained therein.
Figure 7:
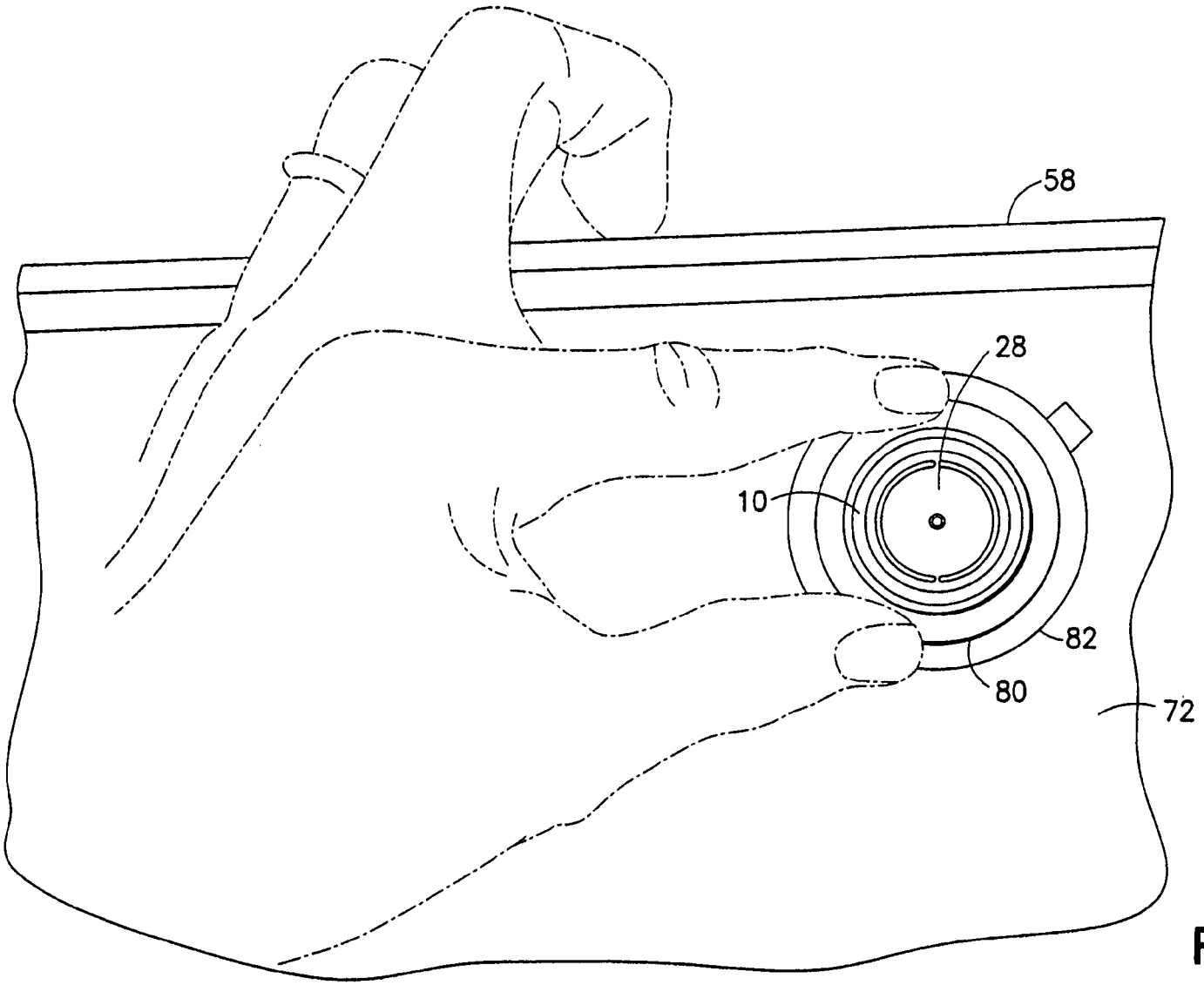
FIG. 7 is a drawing showing an elevational view of a portion of a plastic container having an opening for receiving a valve assembly of a reclosable storage bag. This drawing shows a user placing a retainer ring in coupling relationship with the valve assembly for retaining the latter in the opening.

A first embodiment of the present invention is shown in FIGS. 5-7. As shown in FIG. 6, a portion of an evacuable gusseted reclosable storage bag 60 is placed inside an open plastic container 58 in the form of a tub. The bag may contain a plurality of compressible articles 62 when its bottom portion is placed inside the container 58 or the bag may be empty when its bottom is placed in the container and thereafter the compressible articles are placed inside the bag. At the stage depicted in FIG. 6, the compressible articles have not been compressed yet. The container 58 has walls that are much less flexible than the walls of bag 60. For example, the container 58 may have relatively rigid walls made of a hard plastic composition.

The reclosable storage bag comprises a receptacle 64 having front and rear walls connected by gusseted sidewalls (not shown in FIG. 6). A conventional plastic zipper 66 is installed in the mouth of the receptacle 64. Typically the zipper comprises a pair of zipper strips made of extruded plastic and having mutually interlockable profiles. The ends of the zipper strips are fused together. The zipper is closed by means of a plastic inverted U-shaped slider or clip 68 mounted thereto. The slider may be of the type disclosed in U.S. patent application Ser. No. 10/940,213, filed on Sep. 13, 2004 and entitled "Improved Slider for Use with Evacuable Storage Bags." The slider 68 is capable of closing an open zipper, i.e., by camming the opposing zipper strips into engagement during slider travel in either direction, but cannot be used to open a closed zipper. The slider 68 does not have means for opening the zipper because typically such means (e.g., a separating plow or finger) would leave a gap in the zipper, thereby preventing formation of a hermetic seal. The reclosable bag must be hermetically sealed in order to maintain a vacuum inside after the compressible articles have been compressed by evacuating air out of the bag. Alternative reclosable means, such as opposing strips of cohesive material or a strip of low-tack pressure-sensitive adhesive material, may be used.

The storage bag 60 has a one-way valve assembly 70 that is installed in an opening or port formed in one wall of the flexible (i.e., collapsible) receptacle 64. In the fully assembled state depicted in FIG. 5, the one-way valve assembly 70 is also installed in an opening or port formed in one wall of the relatively rigid container 58. The one-way valve assembly 70 comprises a valve base 10 and a valve element (not visible in FIG. 5) of the type previously described with reference to FIGS. 2 and 3. The one-way valve assembly 70 is designed to receive a cover of the type depicted in FIG. 4 after the bag has been evacuated.

As seen in FIG. 5, the circular outer sidewall 18 of valve base 10 of the one-way valve assembly 70 projects outward through an opening (not shown) in a flexible wall 74 of the storage bag and through an opening (not shown) in a less flexible (i.e., more rigid) wall 72 of the container. After the sidewall 18 of valve base 10 has been passed through the opening in container wall 72, the valve base 10 can be held in place by installing a retainer ring 80. The retainer ring 80 comprises an annular flange 82 and a circular outer sidewall 84 projecting from the inner periphery of the annular flange 82 on one side thereof. The retainer ring 80 can be snapped onto the end of the sidewall 18. As previously described, sidewall 18 has an outer peripheral bead 46 that has a generally constant profile along its circumference. The retaining ring 80 has a sidewall 84 with an inner peripheral bead 86 that is pushed past the bead 46. The retaining ring 80 will be held on by frictional forces as well as by the resistance presented by the bead 46 to removal of the retaining ring. FIG. 7 depicts the retainer ring 80 being snapped into place on the outside of the container 58. The top of the retainer ring 80 has a circular opening through which the valve element 28 is visible. There may be a filter located inside the bag directly over the valve airway to block any possible contamination to the valve element.

Figure 8:
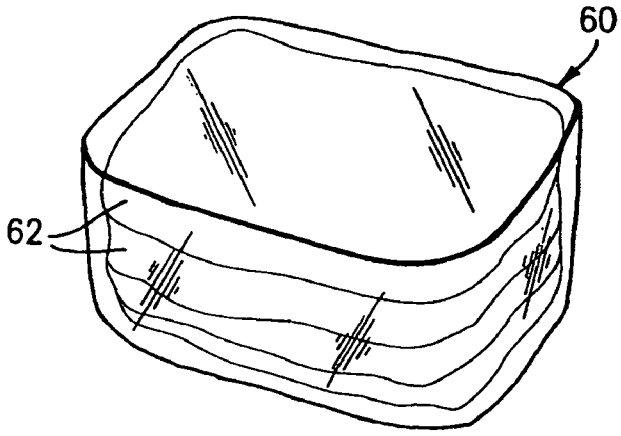
FIG. 8 is a drawing showing a reclosable storage bag with compressed contents after removal from the container.

In accordance with one method of storing compressible articles, the one-way valve assembly of an empty evacuable reclosable storage bag is installed in an opening formed in a wall of a container having relatively rigid walls. The storage bag is then coupled to the container by snapping the retainer ring onto the outer side wall of the valve base of the one-way valve assembly, as depicted in FIG. 7. Thereafter, the zipper 66 is opened and a plurality of compressible articles 62 are placed inside the storage bag, as depicted in FIG. 6. Then the slider 68 is used to close the zipper. Air is then evacuated out through the one-way valve using a vacuum cleaner or similar device in conventional manner, thereby compressing the compressible contents of the storage bag. After the bag has been evacuated, the retainer ring is removed and the bag with compressed contents is removed from the container. A cover is then installed on the one-way valve in place of the retainer ring. As seen in FIG. 8, the resultant storage bag with contents now has been created by a molding effect, that is, the filled bag has a relatively flat surface on the top that allows it to be stacked flat onto other similar storage bags with contents that have been compressed by this method and means.

Figure 9:
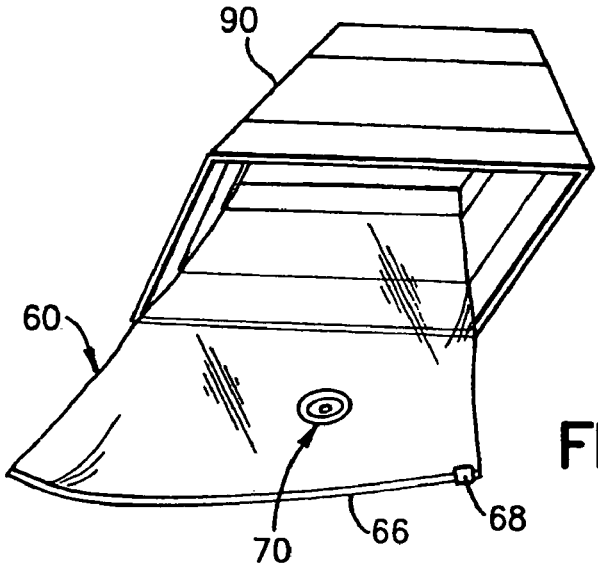
FIG. 9 is a perspective view showing an unassembled cardboard box having an evacuable reclosable storage bag attached to the interior surface of a wall of the box.

A second embodiment of the invention is shown in FIG. 9. An empty airtight evacuable storage bag 60 (gusseted or non-gusseted) with reclosable zipper 66/slider 68 is permanently attached to the interior surface of a sidewall of an unfolded (i.e., not assembled) corrugated cardboard box. Cardboard boxes with attached storage bags may be stored in a flattened state. Such a cardboard box may be assembled in a conventional manner to form a bottom and four sidewalls, with an open top that can be closed by inward folding of the four top flaps in a conventional manner. The upper portion of the reclosable storage bag 60 extends outside the open top of the thus formed box. The accessible upper portion of the reclosable storage bag has a one-way valve 70 of the type previously described. After the box with open top has been formed, compressible contents are placed inside the bag, including the lower portion of the bag that is housed inside the box. Then the zipper 66 is closed by operation of the slider 68. There may be a filter located inside the bag directly over the valve airway to block any possible contamination to the valve element.

Air is then vacuumed out through the one-way valve 70 using a vacuum cleaner or similar device, thereby compressing the compressible contents inside the bag. Again, during the compression process, the walls of the cardboard, which are more rigid than the walls of the storage bag, mold the compressible contents of the bag as they shrink in volume, eventually reaching a size that will fit completely inside the box when it is closed. An airtight cover is then installed on the one-way valve on the outside of the bag to prevent air leakage from the evacuated bag. The cardboard box is then closed and sealed for storage, shipping, or further handling.

In accordance with further embodiments, the walls of the container may be rigid or substantially rigid, i.e., more rigid than the plastic tub or cardboard box disclosed hereinabove. The container walls should be sufficiently rigid to serve as a mold for shaping the compressible articles to be stored during evacuation of the reclosable storage bag.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A storage system comprising:

an evacuable and reclosable bag comprising a bag wall made of a flexible material and a one-way valve attached to said bag wall, wherein said one-way valve comprises a valve base comprising a flange attached to a periphery of a hole in said bag wall and a sidewall projecting through said hole in said bag wall;

a container having container walls made of a material less flexible than said flexible material, wherein one of said container walls has a hole through which said sidewall of said valve base projects; and an attachment device that attaches said bag to said container such that at least a portion of said bag resides within said container, wherein said attachment device comprises a retainer ring that can be alternatingly coupled to and uncoupled from said sidewall of said valve base on the outside of said container with a portion of said container wall disposed between a flange of said retainer ring and said flange of said valve base, said retainer ring having an opening.

2. The system as recited in claim 1, wherein said container comprises a box.

3. The system as recited in claim 1, wherein said container comprises a tub.

4. The system as recited in claim 1, wherein said valve base further comprises a generally annular seat disposed along a periphery of a hole in said valve base, and said one-way valve further comprises a valve element coupled to said valve base for opening said hole in said valve base in a first state and closing said hole in said valve base in a second state, said valve element comprising a diaphragm that is deformable and configured to contact a portion of said generally annular seat along said periphery of said hole in said valve base to close said hole in said valve base when said diaphragm is in full contact around an entire circumference of said periphery of said hole in said valve base in said first state and to separate at least partially from said contacted portion of said generally annular seat to allow fluid flow through said hole in said valve base in said second state, said diaphragm transitioning from said first state to said second state by deformation.

5. The system as recited in claim 1, wherein said bag comprises a reclosable closure.

6. The system as recited in claim 1, wherein said bag can be removed from said container when said retainer ring is uncoupled from said sidewall of said valve base.

* * * * *